US005078409A

United States Patent [19]

Butler et al.

[11] Patent Number: 5,078,409

[45] Date of Patent: Jan. 7, 1992

[54] BOARD GAME

[76] Inventors: William J. Butler; Yatanya K. Butler, both of 3608 Knollbrook Dr., Franklin, Ohio 45005

[21] Appl. No.: 699,575

[22] Filed: May 14, 1991

[51] Int. Cl.[5] ..... A63F 9/00

[52] U.S. Cl. ..... 273/459; 273/236; 273/292

[58] Field of Search ..... 273/429–432, 273/459, 292, 308, 236

[56] References Cited

U.S. PATENT DOCUMENTS 2,812,183 11/1957 Schiff ..... 273/459 X 4,679,796 7/1987 Rein ..... 273/236

*Primary Examiner*—Paul E. Shapiro

*Attorney, Agent, or Firm*—Leon Gilden

[57] ABSTRACT

A playing board includes a perimeter of spaces, wherein a predetermined plurality of cards is shuffled and positioned to cover the perimeter of spaces. A die member is provided to provide direction to a starting orientation relative to a plurality of players and subsequently, each player takes turns in selecting a card. An opposing player to correctly guess a facial expression by a moving player receives the selected card. A player with the most cards at the end of the game is declared a winner. A prop is provided to provide masking of a moving player's face to provide limited clues as to the type of expression of the moving player.

3 Claims, 4 Drawing Sheets

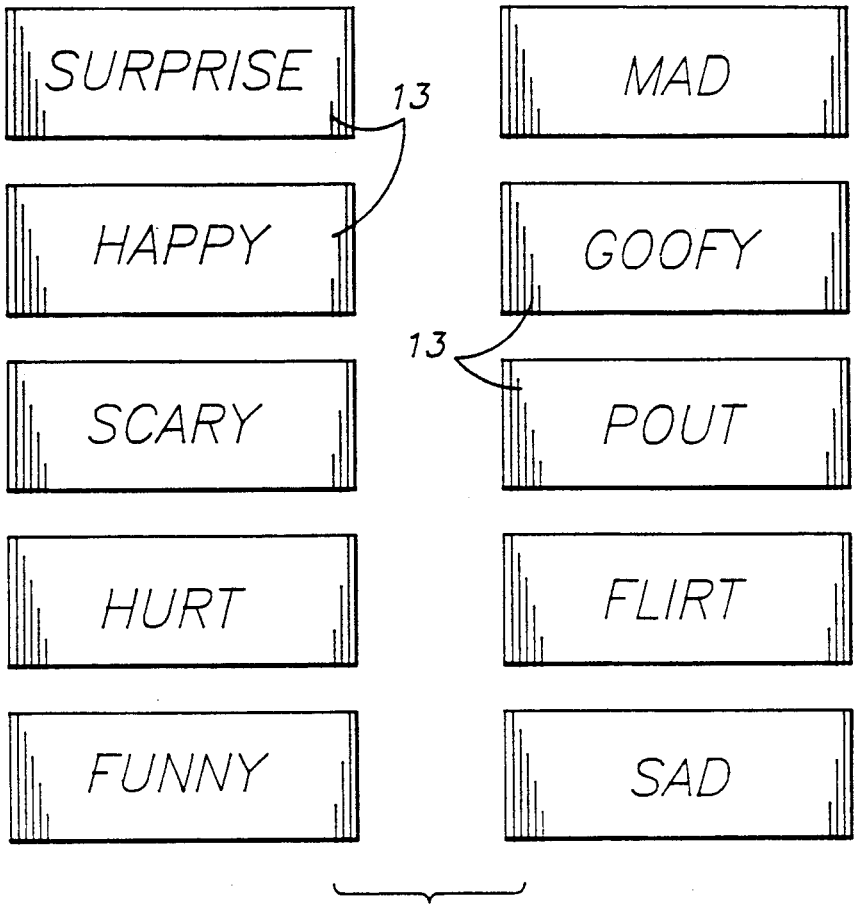
FIG 7
FIG 8
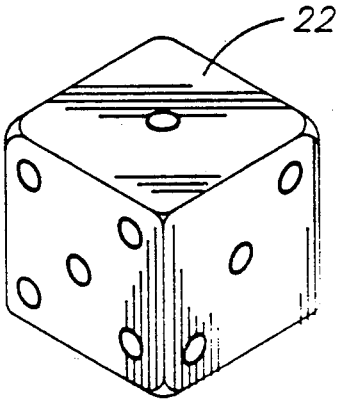

BOARD GAME

BACKGROUND OF THE INVENTION

1. Field of the Invention

The field of invention relates to board games, and more particularly pertains to a new and improved board game wherein the same is arranged to provide opposing players with opportunities to guess facial expressions in a learning and entertaining experience.

2. Description of the Prior Art

Board games of various types have been utilized in the prior art for entertaining and amusement purposes. Board games are arranged to provide education and entertainment in a variety of disciplines to include mathematics, science, and the like.

Examples of such prior art may be found in U.S. Pat. No. 3,410,003 to Sovijarvi, et al wherein a display panel provides selective illumination of various components for indication of various facial features of an individual.

U.S. Pat. No. 1,942,370 to Jacobson sets forth a head member that provides for changeable portions to change expressions thereon.

U.S. Pat. No. 3,775,867 to Christenberry, Jr wherein a display device sets forth equipment to provide a facsimile construction of various portions of the human body utilizing x-ray techniques.

As such, it may be appreciated that there continues to be a need for a new and improved board game as set forth by the instant invention which addresses both the problems of ease of use as well as effectiveness in providing education and entertainment in the understanding and transmission of various facial features of an individual and their meaning.

SUMMARY OF THE INVENTION

In view of the foregoing disadvantages inherent in the known types of board games organizations now present in the prior art, the present invention provides a board game wherein the same is arranged to provide for teaching of various facial features of individuals. As such, the general purpose of the present invention, which will be described subsequently in greater detail, is to provide a new and improved board game which has all the advantages of the prior art board game methods and apparatus and none of the disadvantages.

To attain this, the present invention provides a playing board including a perimeter of spaces, wherein a predetermined plurality of cards is shuffled and positioned to cover the perimeter of spaces. A die member is provided to provide direction to a starting orientation relative to a plurality of players and subsequently, each player takes turns in selecting a card. An opposing player to correctly guess a facial expression by a moving player receives the selected card. A player with the most cards at the end of the game is declared a winner. A prop is provided to provide masking of a moving player's face to provide limited clues as to the type of expression of the moving player.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed Description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the Public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game which has all the advantages of the prior art board game organizations and none of the disadvantages.

It is another object of the present invention to provide a new and improved board game which may be easily and efficiently manufactured and marketed.

It is a further object of the present invention to provide a new and improved board game which is of a durable and reliable construction.

An even further object of the present invention is to provide a new and improved board game which is susceptible of a low cost of manufacture with regard to both materials and labor, and which accordingly is then susceptible of low prices of sale to the consuming public, thereby making such board games economically available to the buying public.

Still yet another object of the present invention is to provide a new and improved board game which provides in the apparatuses and methods of the prior art some of the advantages thereof, while simultaneously overcoming some of the disadvantages normally associated therewith.

Still another object of the present invention is to provide a new and improved board game wherein the same is arranged to provide understanding of various facial features and their meaning, and particularly to children.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed Description thereof. Such Description makes reference to the annexed drawings wherein:

FIG. 7 is an orthographic view of the cards utilized by the instant invention.

FIG. 8 is an isometric illustration of the dice member utilized by the instant invention.

DESCRIPTION OF THE PREFERRED EMBODIMENT

Figure 1:
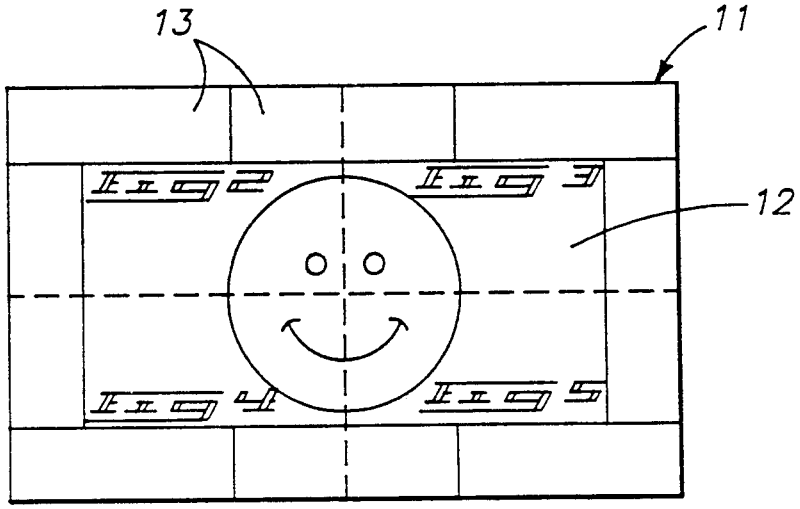
FIG. 1 is a top orthographic illustration of the game board of the instant invention.
Figure 2:
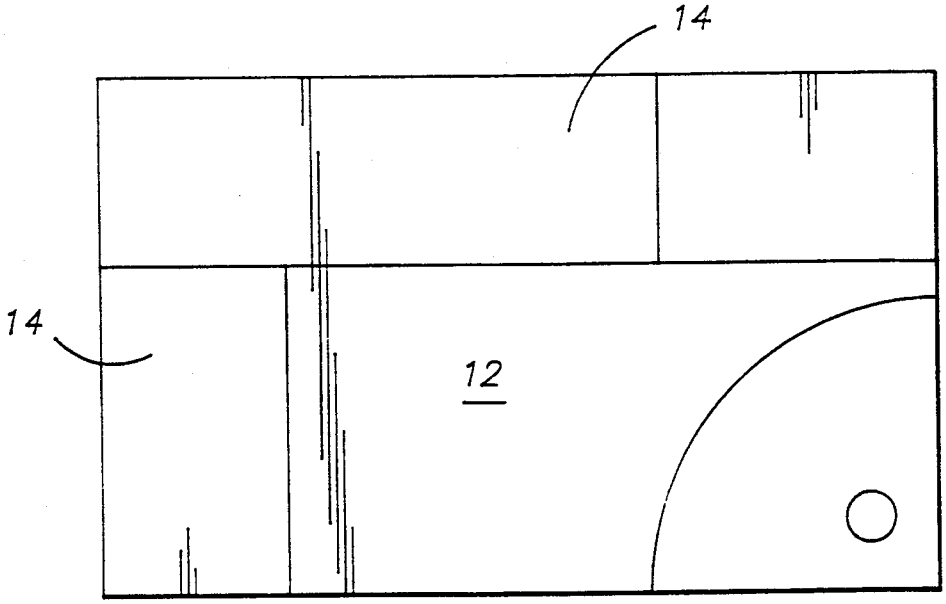
FIG. 2 is an orthographic view of section 2, as set forth in FIG. 1.
Figure 3:
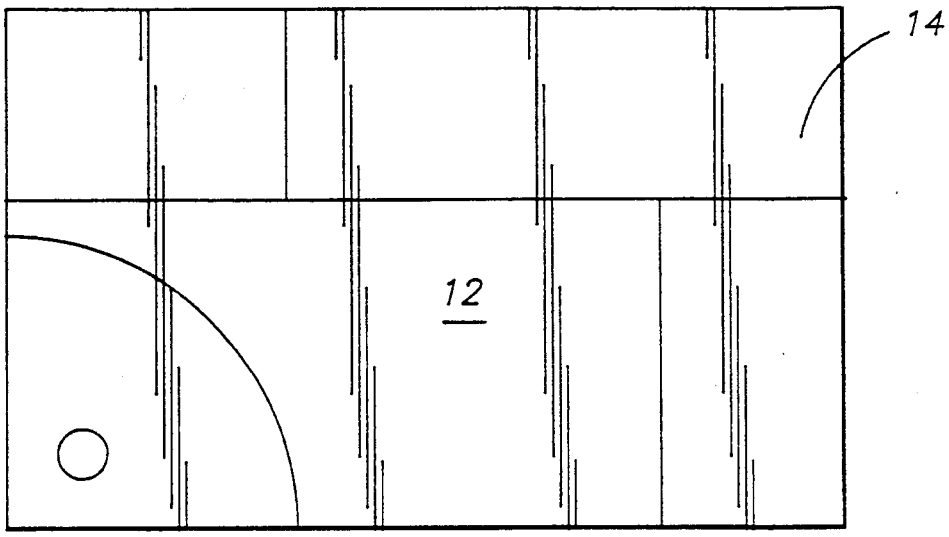
FIG. 3 is an orthographic view of section 3, as set forth in FIG. 1.
Figure 4:
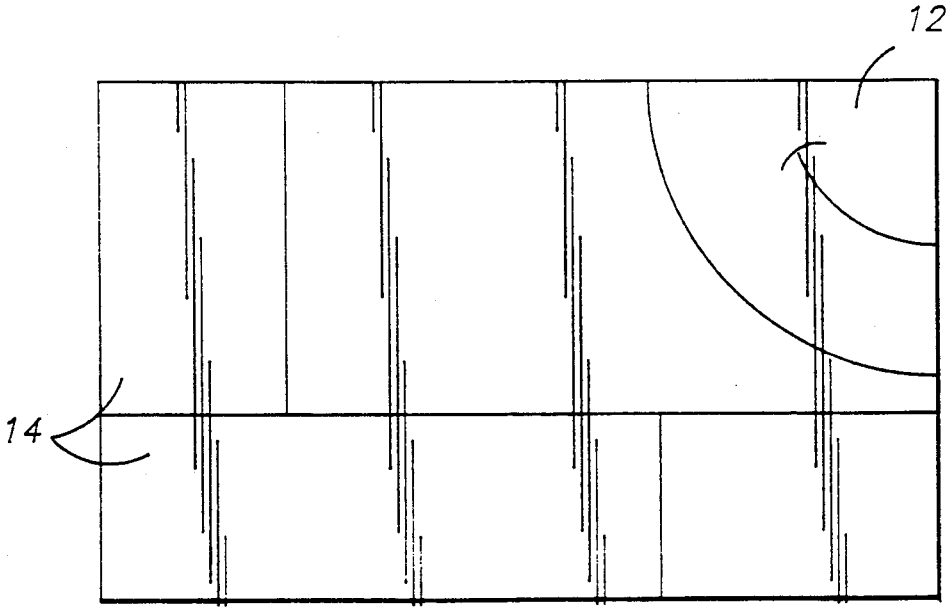
FIG. 4 is an orthographic view of section 4, as set forth in FIG. 1.
Figure 5:
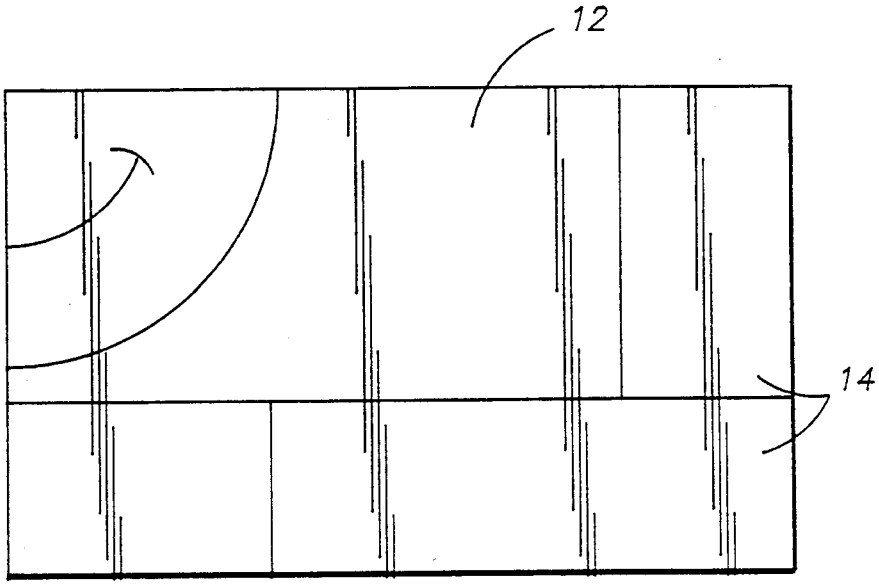
FIG. 5 is an orthographic View of section 5, as set forth in FIG. 1.
Figure 6:
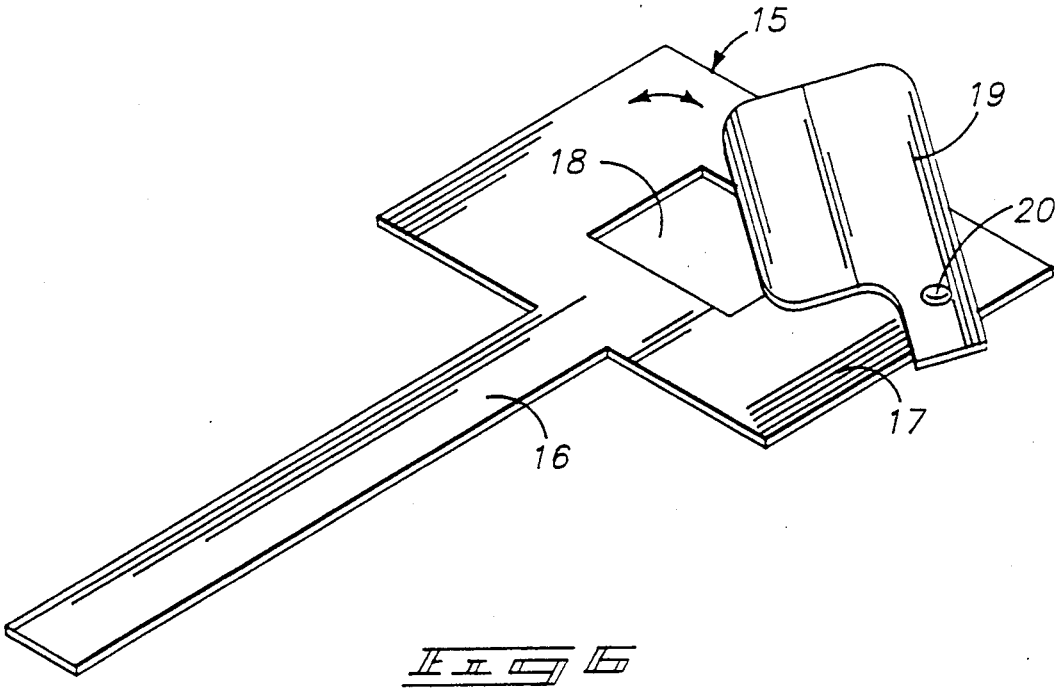
FIG. 6 is an isometric illustration of the mask structure utilized by the instant invention.

With reference now to the drawings, and in particular to FIGS. 1 to 5 thereof, a new and improved board game embodying the principles and concepts of the present invention and generally designated by the reference numerals 11–22 will be described.

More specifically, the board game of the instant invention essentially comprises a game board 11 formed with a top surface, including a center dice rolling area 12 positioned centrally of and surrounded by perimeter spaces 14. A plurality of directional game cards 13 (see FIGS. 1 and 7) are initially shuffled and positioned face down upon the perimeter spaces 14. The game cards 13 are presented with a predetermined first number of such game cards, wherein the perimeter spaces utilize a predetermined second number of such spaces, wherein the predetermined first number is greater than the predetermined second number to thereby provide variation in the facial expressions available on the spaces for a plurality of players to utilize. A dice member 22 is provided of a generally six-sided configuration and the like, wherein each player of a plurality of players rolls the dice member 22 to determined sequence of play, wherein for example the lowest number will proceed first, the second West number second, etc. The game cards 13 are shuffled and placed face down on the game board 11 to occupy all of the spaces 14. A moving player, or first player, of a plurality of players initially selects randomly one of the cards 13 and subsequently attempts to mimic the direction or type of facial expressed upon the game card, whereupon a further player to ascertain the type of expression is presented the game card. When all of the game cards 13 are removed during subsequent turns of players from the spaces 14, a player having accumulated the most game cards is declared a winner.

To enhance difficulty in ascertaining the facial expression of the moving or first player, the moving player may mask his face by positioning the "T" shaped face mask 15 to cover the moving player's face. The face mask 15 is formed with a handle 16 and a facial plate 17 that is coplanar with the handle 16 mounted at an upper terminal end thereof. The facial plate 17 is formed with a central part aperture 18 defined by a first predetermined area. An aperture shield plate 19 is pivotally mounted to selectively cover a portion or all of the central plate aperture 18, and is defined by a predetermined second area greater than the first area. The shield plate 19 is pivotally mounted to the face shifted plate by a pivot axle 20. In this manner, a moving player covers the moving player's face and presents portions of a moving player's face for clues, such as permitting a second or further player to view merely the eye of the moving player, the lips, and the like until a full understanding of the type of expression to be guessed is effected by one of the remaining players.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A method of playing a board game, comprising the steps of, providing a game board, and providing the game board with a center dice rolling area and a perimeter of game card spaces continuously about the dice rolling area, and providing a first predetermined number of directional game cards, each of the game cards is provided with a varying direction of facial expression, and providing the perimeter spaces as a predetermined second number, wherein the predetermined first number is greater than the predetermined second number, and providing a dice member, and including a plurality of players to effect playing of the game, and each player of the plurality of players consecutively rolls the dice member, wherein sequence of play of the plurality of players is decided, and a predetermined second number of game cards are positioned face down subsequent to shuffling on the predetermined second number of perimeter spaces, and a moving player selects randomly a game card of the plurality of game cards and mimics a direction for facial expression of that game card, and further players of the plurality of players sequentially guess the facial expression of the moving player, whereupon a first player to correctly guess the facial expression of the moving player is provided the predetermined game card, whereupon a player of the plurality of players is declared the winner upon accumulating the greatest number of the predetermined second number of game cards.

2. A method as set forth in claim 1 wherein the moving layer positions a face shield over a face of the moving player, wherein the face shield is provided with a central aperture, and the central aperture includes an aperture shield plate pivotally mounted to overlie selective portions of such aperture to provide limited viewing access to the player's face.

3. A board game, comprising in combination, a game board, the game board including a central dice rotating area, and the game board further including a predetermined second number of spaces about a perimeter portion of the game board, and further including a predetermined first number of directional game cards, the predetermined first number is greater than the predetermined second number to provide a variation of directional cards upon the spaces, and a dice member for determining selective sequence of play among a plurality of players, and further including a "T" shaped face mask for positioning the face mask to cover a portion of each face of the plurality of players, wherein the face mask includes a handle, the handle includes a facial plate, the facial plate coplanar and fixedly mounted to an upper terminal end of the handle, the facial plate including a central plate aperture defined by a predetermined first area, and further including an aperture shield plate pivotally mounted over the central plate aperture, wherein the aperture shield plate is defined by a predetermined second area, wherein the predetermined second area is greater than the predetermined first area to ensure complete selective covering of the central plate aperture, and a pivot axle orthogonally directed through the aperture shield plate and the facial plate for pivotally mounting the aperture shield plate relative to the face shield plate for selective masking of various portions of each player's face in presenting clues to remaining players, and the directional game cards each including direction means for directing each player to mimic the direction means, wherein the direction means includes a particular facial expression.

* * * * *